US005641151A

United States Patent [19]

Kataoka

[11] Patent Number: 5,641,151

[45] Date of Patent: Jun. 24, 1997

[54] CHAIN LEVER HOIST

[75] Inventor: Kozo Kataoka, Osaka, Japan

[73] Assignee: H.H.H. Manufacturing Co., Osaka, Japan

[21] Appl. No.: 433,615

[22] Filed: May 3, 1995

[30] Foreign Application Priority Data

May 13, 1994 [JP] Japan ..... 6-124207

[51] Int. Cl.[6] ..... B66D 1/14

[52] U.S. Cl. ..... 254/352; 254/368; 254/372; 192/70.22; 192/111 B; 192/95

[58] Field of Search ..... 254/352, 346, 254/368, 372; 192/70.11, 70.22, 111 B, 114 R, 95, 94

[56] References Cited

U.S. PATENT DOCUMENTS 2,735,528 2/1956 Dodge ..... 192/70.22 X
3,520,392 7/1970 Deremo et al. ..... 192/114 X
4,469,308 9/1984 Nakamura et al. .
4,775,040 10/1988 Telford ..... 192/94 X

FOREIGN PATENT DOCUMENTS 0583550 2/1994 European Pat. Off. .

*Primary Examiner*—Daniel P. Stodola
*Assistant Examiner*—Emmanuel M. Marcelo
*Attorney, Agent, or Firm*—W. G. Fasse; W. F. Fasse

[57] ABSTRACT

The free-running operation of a load sheave of a chain lever hoist is assured by an assist mechanism that keeps the relative position between a hub and a spindle of the hoist at a brake inactive position, when the screwing control position of the hub relative to the spindle has been shifted from a winding operation position to a free-running operation position. operator can easily switch the hoist to the free-running operation made by slightly turning a hub knob and a spindle knob by hand. Such an operation eliminates steps such as holding the chain by hand, or turning the spindle while the hoist lever is engaged with the hub. The above operation frees an operator from getting his hands dirty with the chain, and permits an immediate switching to the free-running operation. The use of indicators allows the operator to recognize the free-running operation setting at a glance.

17 Claims, 10 Drawing Sheets

CHAIN LEVER HOIST

BACKGROUND OF THE INVENTION

1. Field of the Invention

The present invention relates to a chain lever hoist that raises or lowers a load by means of a manually operated lever action and has a feature to allow its chain to run freely.

2. Description of the Related Art

A chain lever hoist must offer free-running operation of its chain wheel in shave, sometimes called a "load sheave", to allow for the free running of the chain, in addition to raising or lowering operation (hereinafter referred to as upward or downward winding operation), of the load chain by means of a lever action.

FIG. 13 shows one type of conventional chain lever hoist known as a spring chain lever hoist that comprises a mainframe (I), a load sheave (Ro) freely rotatably supported by the mainframe (I), a spindle (Ha) supported by the mainframe (I) in a manner that allows the spindle to integrally rotate with the load sheave (Ro), a fixed friction plate (Ni) secured to the spindle (Ha), a hub (He) into which the spindle (Ha) is screwed and which is rotated by a lever (Ho) that is pivoted around the spindle (Ha), a ratchet gear (To) with two brake linings (Ti, Ti) arranged respectively on each side of the rachet gear (To) between the fixed friction plate (Ni) and the hub (He) in such a manner that the ratchet gear (To) rotates freely around the spindle (Ha), and a ratchet pawl (Ri) that is mounted on the mainframe (I) in such a manner that the ratchet pawl (Ri) engages with the ratchet gear (To) to be allowed to rotate only in the direction of the upward winding operation. The distance between the fixed friction plate (Ni) and the hub (He) can be adjusted or varied by rotating the hub (He) i.e. screwing it more or less onto the spindle (Ha), in such a way as to squeeze or release the ratchet gear (To) and the brake linings (Ti, Ti). Furthermore, as an assist mechanism, a coil spring (Nu) is disposed between the fixed friction plate (Ni) and the hub (He) so that the force of the coil spring (Nu) constantly, urges the hub (He) outwardly (to the right-hand side in FIG. 13), thereby reducing the contact pressure between the brake lining (Ti) and the hub (He), and thus decreasing the braking effect.

A discussion of the operation of the conventional spring chain lever hoist follows. To carry out an upward winding operation, a switch pawl (Ru) first operated to engage with a switch gear (Wo) of the hub (He) in the upward winding direction, whereby the hub (He) is allowed to rotate only in the upward winding direction. The lever (Ho) is pivoted in the upward winding direction, and the torque generated by a suspended load on the chain causes the hub (He) to be screwed inwardly along the spindle (Ha) in such a manner that the hub (He) and the fixed friction plate (Ni) squeeze the ratchet gear (To) and the brake linings (Ti, Ti) therebetween. Thus, the torque of the lever (Ho) is transmitted from the hub (He) to the load sheave (Ro) via one brake lining (Ti), the ratchet gear (To), the other brake lining (Ti), the fixed friction plate (Ni), and the spindle (Ha). The ratchet gear (To) rotates with the ratchet pawl moving or oscillating thereon, causing the load sheave (Ro) to rotate in the upward winding direction. The load is thus lifted up.

To carry out a downward winding operation, the switch pawl (Ru) is operated to engage with the switch gear (Wo) in the downward direction, whereby the hub (He) is allowed to rotate only in the downward winding direction. The torque generated by a suspended load causes the hub (He) to be screwed inwardly along the spindle (Ha) in such a manner that the hub (He) and the fixed friction plate (Ni) squeeze the ratchet gear (To) and the brake linings (Ti) therebetween in the same manner as in the upward winding operation. When the lever (Ho) is pivoted in a downward winding direction, however, the squeezing force is decreased by the torque of the lever (Ho). Thus, the fixed friction plate (Ni) slides against the ratchet gear (To), and the fixed friction plate (Ni), the spindle (Ha) and the load sheave (Ro) rotate in the downward winding direction in accordance with the degree of rotation of the hub (He). Thus, the load is lowered.

To carry out a free running operation, the switch pawl (Ru) is operated to disengage from the switch gear (Wo), whereby the lever (Ho) is disengaged from the hub (He). The hub (He) is rotated to be spaced apart from the fixed friction plate (Ni), and the contact pressure of the hub (He) against the ratchet gear (To) and the brake linings (Ti, Ti) is reduced. The coil spring (Nu) urges the hub (He) outward, rendering the braking action ineffective. Thus, the load sheave (Ro) is allowed to rotate freely.

In lever hoist of this type described above, it is common for a heavy duty hoist with a load capacity of 0.5 tons or more to have its load sheave and spindle linked through a plurality of reduction gears as shown in FIG. 13. However a light hoist with a load capacity of less than 0.5 tons commonly has its load sheave and spindle connected to each other directly.

In the above-described conventional spring lever hoist, the following problems arise. The assist mechanism comprising coil spring (Nu) blocks the screwing control position of the hub from returning to the winding operation position, when the screwing control position of the hub (He) relative to the spindle (Ha) is shifted. To perform the above operation, the hub (He) must be rotated while the chain is held by hand, or the spindle (Ha) must be rotated while the lever (Ho) is engaged with the hub (He) (typically by allowing the switch pawl (Ru) to engage with the switch gear (Wo) of the hub (He)). The first method permits an immediate switching to the free-running operation, but an operator must use both hands and gets his hands dirty in the operation. The second method allows a single-handed operation, but the operation is a two-step sequence because a locking engagement step is involved. In the second method, the rotation of the spindle may be carried out by pulling the chain. This option may be useful when the spindle (Hal is out of reach of the operator's hand. However, the operator is not freed from getting his hands dirty, and the operation remains a two-step sequence. Also, the operator cannot judge the operation position or mode by just looking at the switch pawl, because the appearance of the switch pawl does not show the condition of whether the contact pressure of the hub against the ratchet gear and the brake linings is reduced or not.

SUMMARY OF THE INVENTION

The present invention has been developed in view of the above problems. It is an object of the present invention to provide a chain lever hoist in which an operator can switch instantly to a free-running operation without holding the chain by hand, but instead by holding the hub and the spindle with both hands and carrying out an operation of shifting the screwing control position of the hub relative to the spindle, while the conventional operation methods are still retained as options. It is an additional object of the present invention to provide a chain lever hoist that offers ease and convenience of use by providing an indicator that clearly indicates whether the chain lever hoist is at its winding operation setting or free-running operation setting.

To achieve the above objects, the chain lever hoist according to the present invention comprises a mainframe, a spindle freely rotatably mounted on the mainframe, a load sheave mounted on the mainframe so that it can rotate with the spindle, a fixed friction plate fixed to the spindle. Furthermore, a hub having a switch gear is screwed onto the spindle. A lever having a switch pawl is pivoted about the spindle. A ratchet gear and brake linings are disposed between the fixed friction plate and the hub in such a manner that the ratchet gear and the brake linings are freely rotatable about the spindle. A ratchet pawl is mounted on the mainframe in such a manner that allows the ratchet pawl to engage with the ratchet gear so that it is allowed to rotate only in the upward winding direction. The present hoist further may include an assist mechanism that blocks the hub from returning to a winding operation position after the screwing control position of the hub relative to the spindle has been shifted from the winding operation position to a free-running operation position. A hub knob is disposed on the hub and a spindle knob is disposed on the end of the spindle that passes through and projects out of the hub. Indicators are provided on the hub knob and and the spindle knob are arranged so as to indicate the relative position between the hub knob and the spindle knob.

The above mentioned winding operation position includes the upward winding operation position and the downward winding operation position. The former is defined as a position in which the switch pawl engages with the switch gear so that the lever torque in the upward winding direction can be transmitted to the hub, and the ratchet gear and the brake linings are squeezed between the hub and the fixed friction plate. The latter is defined as a position in which the switch pawl engages with the switch gear so that the lever torque in the downward winding direction can be transmitted to the hub, and the ratchet gear and the brake linings are squeezed between the hub and the fixed friction plate. The free-running operation position is defined as a position in which the switch pawl disengages from the switch gear so in which the torque of the lever cannot be transmitted to the hub, and the contact pressure of the hub against the ratchet gear and the brake linings is lightened or relieved.

Three different arrangements are available as the assist mechanism. The first such arrangement is a spring type arrangement in which an elastic body such as a coil spring is disposed between the fixed friction plate and the hub to urge the hub outwardly as already described in the prior art. A second arrangement is one in which a friction material such as a rubber member is disposed between the hub and the spindle to generate a sliding resistance above a predetermined threshold value between the hub and the spindle. A third arrangement is one which, the screwing control position is blocked from returning to the winding operation position, when the screwing control position of the hub relative to the spindle is shifted from the winding operation position to the free-running operation position, which is slightly offset from the winding operation position (reference is made to European Patent Application Publication No. 583550A2). The third arrangement also includes a mechanism wherein the hub is connected to a front hub, the spindle passes through the front hub, a pair of cylinders are fixed to the front end portion of the spindle at right angles with respect to the spindle in diametrically opposite directions, a ball is received in the outer end of each one of the cylinders, a coil spring is loaded in each cylinder so that the ball is urged toward the inner wall of the front hub, the front hub has a pair of recesses in a diametrically opposite positions on its inner wall, and the recesses are adapted to receive the balls when they are aligned with the recesses.

In the chain lever hoist according to the present invention, to carry out an upward winding operation, the switch pawl is operated to engage with the switch gear in the upward winding direction and the lever is pivoted in the upward winding direction. The torque of a suspended load screws the hub inwardly onto the spindle, squeezing the ratchet gear and brake linings between the hub and the fixed friction plate. When the lever further rotates the hub in the upward winding direction, the torque of the lever is transmitted to the load sheave via the hub, one brake lining, the ratchet gear, the other brake lining, the fixed friction plate, and then the spindle. The ratchet gear rotates with the ratchet pawls oscillating on the teeth of the ratchet gear. The load sheave is thus rotated in the upward winding direction.

To carry out a downward winding operation, the switch pawl is operated to engage with the switch gear in the downward winding direction and the torque of a suspended load screws the hub inwardly onto the spindle, squeezing the ratchet gear and brake linings between the hub and the fixed friction plate. When the lever rotates the hub in the downward winding direction, the squeezing force is decreased during the rotation of the hub. Thus the fixed friction plate slides against the ratchet gear, and the fixed friction plate, the spindle and the load sheave rotate in response to the rotation of the hub.

To carry out a free-running operation, the switch pawl is operated to disengage from the switch gear and the assist mechanism blocks the screwing control position from returning to the winding operation position once the screwing control position of the hub relative to the spindle has been shifted from the winding operation position to the free-running operation position. The relative position of the hub to the spindle is thus kept at an open brake position. The free-running of the load sheave is thus assured.

In this case, if the hub knob and the spindle knob are both held by hand and slightly rotated, the position of the hub relative to the spindle is easily shifted, unlike the conventional arrangement in which the chain must be held by hand or the spindle must be rotated while the lever is engaged with the hub. Without the steps such as holding the chain by hand or rotating the spindle while the lever is engaged with the hub, the switching operation is completed. An operator is thus freed from getting his hands dirty and can instantly switch to the free-running operation with ease.

The relative position between the hub knob and the spindle knob is clearly indicated by the indicators. At a glance, the operator recognizes whether the chain lever hoist is at its winding operation setting or free-running operation setting. The operator thus easily and surely determines the condition of the chain lever hoist.

DETAILED DESCRIPTION OF THE PREFERRED EMBODIMENTS

Figure 1:
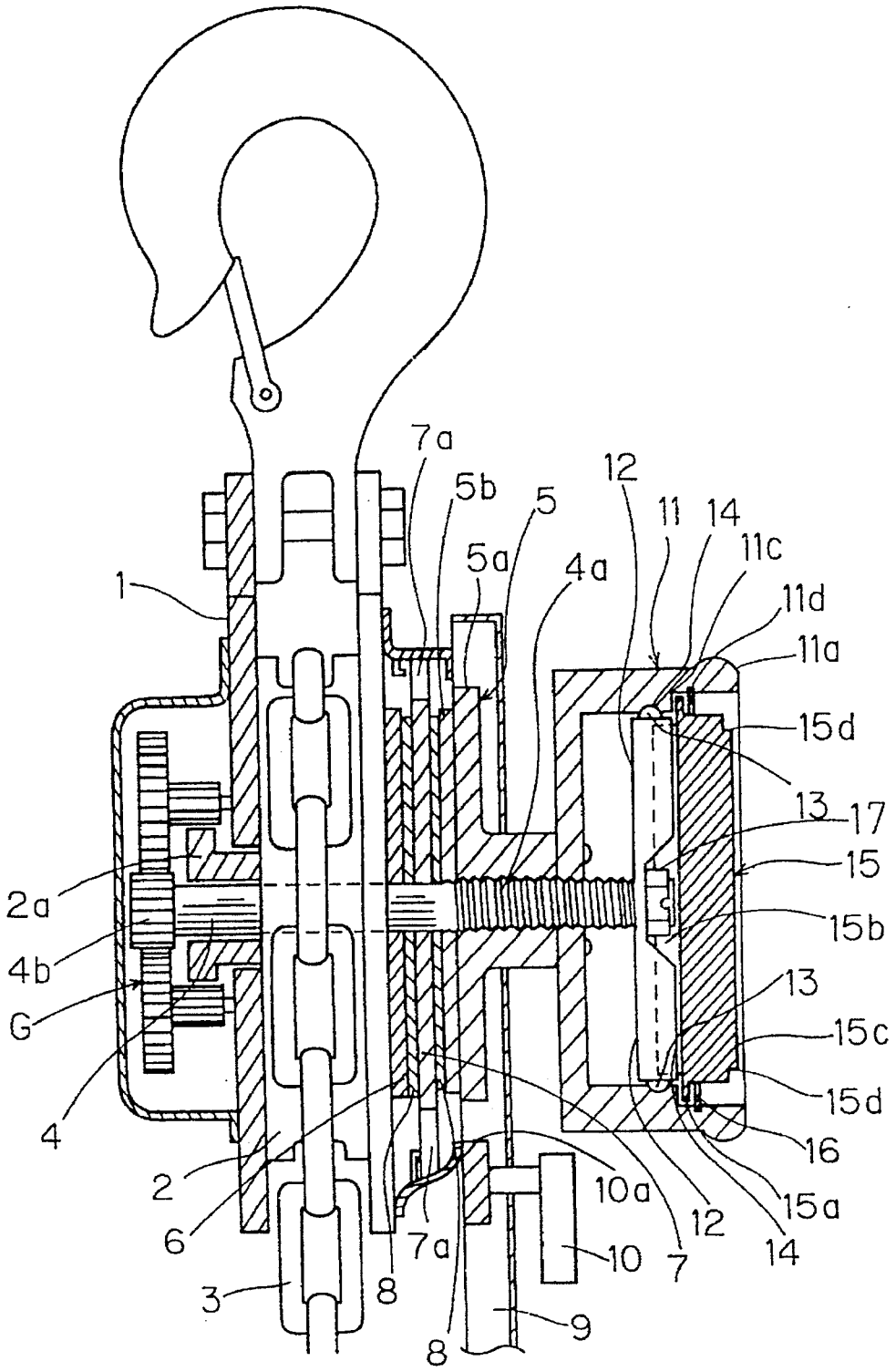
FIG. 1 is a vertical cross-sectional view showing generally the first embodiment of the chain lever hoist according to the present invention.
Figure 2:
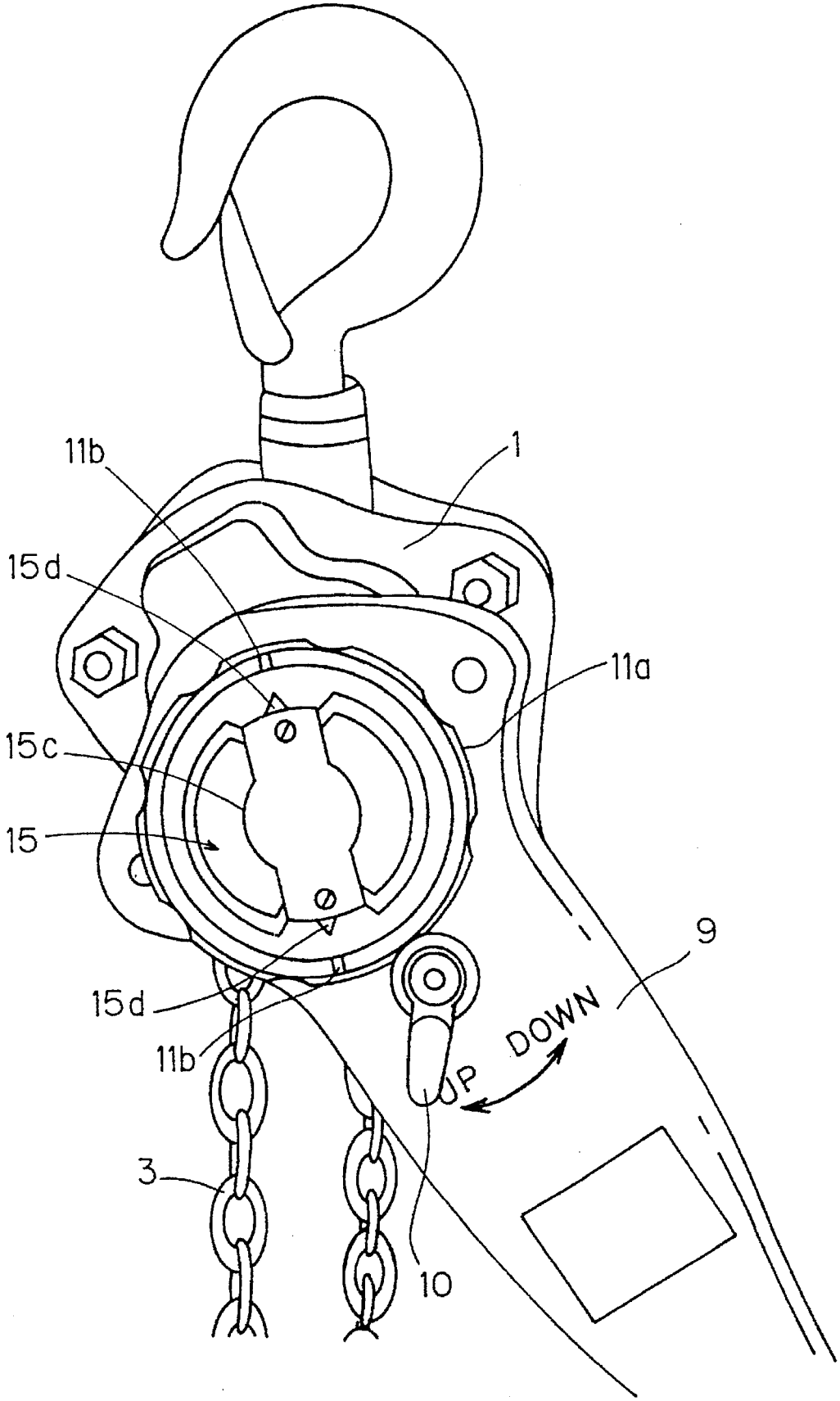
FIG. 2 is a front view showing the first embodiment.
Figure 3:
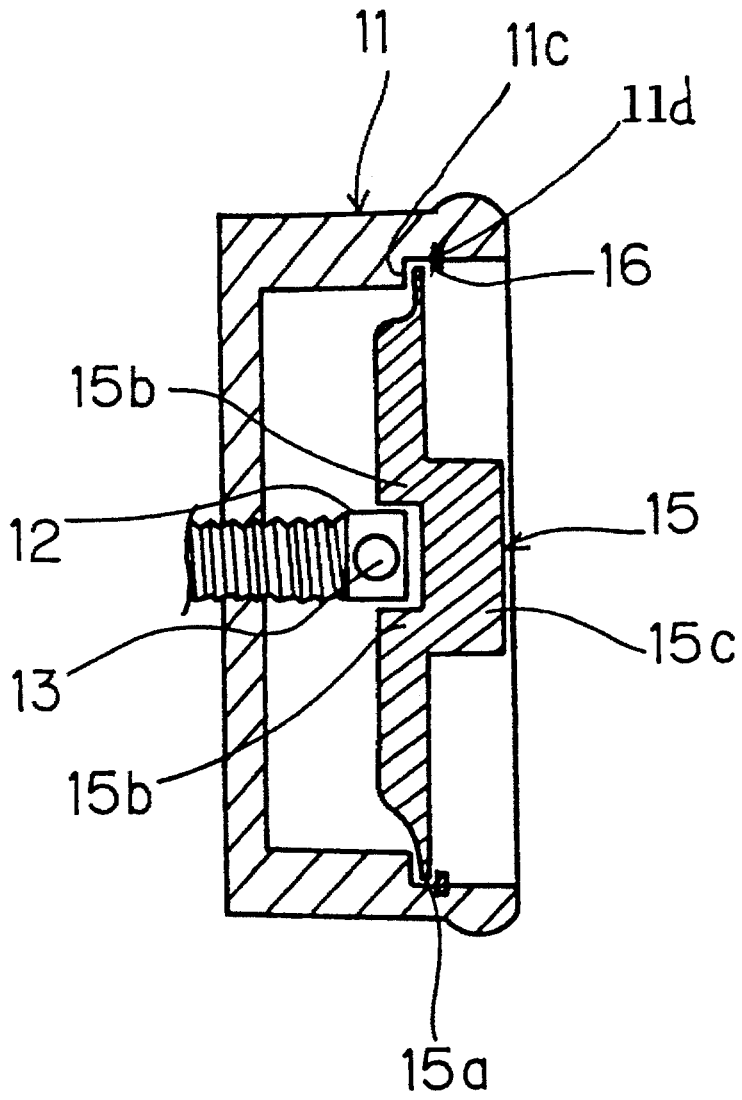
FIG. 3 is a cross-sectional view showing a front hub and its associated components of the first embodiment.
Figure 4:
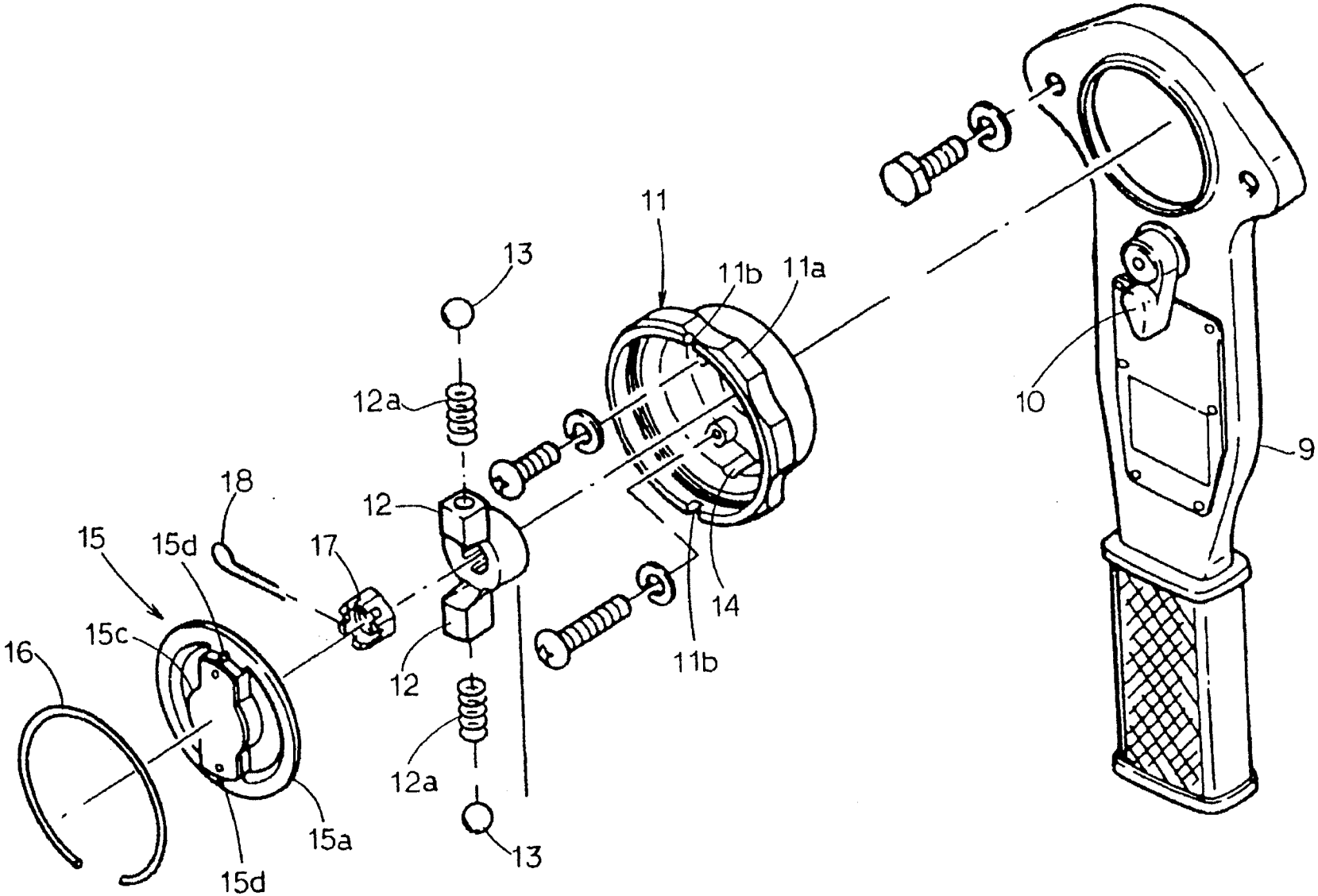
FIG. 4 is an exploded perspective view showing generally the chain lever hoist according to the first embodiment.

Referring to the drawings, the embodiments of the present invention will now be discussed. FIGS. 1 through 4 show the first embodiment. Shown in these figures are mainframe 1, a load sheave 2 freely rotatably mounted on the mainframe 1, a chain 3 engaged with the load sheave 2, and a spindle 4 freely rotatably mounted on the mainframe 1, and having at one end a spindle gear **4*b* that is coupled with a gear 2*a* of the load sheave 2 via a group of reduction gears G, and having at the other end a threaded portion 4*a*. A disc-like hub 5 has at its center an internally threaded bore into which the threaded portion 4*a* of the spindle 4 is screwed. The hub 5 is integrally connected to a friction plate 5*b* and a switch gear 5*a*. A fixed friction plate 6 is fixed to the spindle 4. Disposed between the friction plate 5*b* and the fixed friction plate 6 are a ratchet gear 7 and two brake linings 8, one for each side of the ratchet gear 7, in a manner such that the ratchet gear 7 and the brake linings 8 are freely rotatable about the spindle 4. By rotating the hub 5, the clearance between the fixed friction plate 6 and the hub 5 is varied, so as to squeeze or release the ratchet gear 7 and the brake linings 8 therebetween. Also shown are a pair of ratchet pawls 7*a* that are mounted on the mainframe 1 in a manner such that the pawls 7*a* are engaged with the ratchet gear 7 so that it is allowed to rotate only in the upward winding direction. A lever 9 is arranged to be pivotable about the spindle 4. A switching knob 10 is freely rotatably mounted on the lever 9 and switches or selects the upward winding operation, the free running operation and the downward winding operation. The knob 10, on its internal end, is provided with a U-shaped pawl 10*a* adapted to selectively engage with the switch gear 5*a* of the hub 5**.

Attached by screws to the front of the hub 5 (on the right-hand side in FIG. 1) is a pan-like front hub 11. The front hub 11 accommodates an assist mechanism that blocks the hub 5 from returning to its winding operation position along the spindle 4 after the hub 5 has been screwed or shifted along the spindle 4 to its free running operation position. The spindle 4 is screwed into the front hub 11. A pair of cylinders 12, 12 are fixed to the end of the spindle 4 in a manner that the cylinders 12 are diametrically opposite to each other with respect to the spindle 4. Each cylinder has at its outer end a ball 13, and inside each cylinder there is a coil spring **12*a* which urges the ball 13 toward the internal wall of the front hub 11. The front hub 11 on its inner circumference is provided with a pair of recesses 14, 14, diametrically opposite to each other in order to receive the balls 13 of the cylinders 12. The front hub 11 may be separately manufactured and then attached to the hub 5 by screws in this embodiment. Alternatively, both the hub 5 and the front hub 11 may be integrally formed, and the front portion of the integral hub may be treated like the front hub 11**.

The positional relationship of the hub 5 with the spindle 4 will now be discussed. The front hub 11 is set to its upward winding operation position in FIG. 5, and is set to its downward winding operation position in FIG. 6. In both cases, the front hub 11 is rotated clockwise to screw the hub 5 inwardly along the spindle 4. In this condition, the balls 13, 13 of the cylinders 12, 12 remain in contact with the inner wall of the front hub 11. In FIG. 7, the front hub 11 is set to its free running operation position that is slightly offset from its winding operation position. Namely, the front hub 11 is rotated counterclockwise by a slight angle of rotation so that the balls 13, 13 of the cylinders 12, 12 are seated in the recesses 14, 14. In this condition, the front hub 11 is put into its half-locking engagement. The term "half-locking engagement" refers to a condition or setting in which the hub 5 and the spindle 4 remain engaged when an applied torque is equal to or less than a threshold value, but become disengaged when the applied torque is greater than the threshold value.

The outer circumference **11*a* of the front hub 11 has an undulating wavy or grooved surface so that it is easy to grip when operated and it functions as a hub knob. The spindle 4 at its one end is provided with a spindle knob. Namely, a cap 15 covers the cylinders 12, 12. As shown in FIGS. 1 through 4, the cap 15 comprises a disc 15*a*, a guide 15*b* that is so shaped that it receives the cylinders 12, 12 in its rear face, a spindle knob 15*c* extending diametrically on the disc 15*a*, and a pair of spindle indicators 15*d*, respectively disposed at opposite ends of the spindle knob 15*c* for indicating the angular position of the cap 15. The front hub 11 is provided with a pair of notches 11*b* as hub indicators to indicate the angular position of the hub 5. The notches 11*b* and the indicators 15*d* indicate the relative position of both knobs 11*a*, 15*c*. The inner wall of the front hub 11 is provided with a step portion 11*c*, and an annular groove 11*d* is disposed on the larger diameter portion between the step portion 11*c* and the end of the front hub 11. A snap-in ring 16 is seated in the groove 11*d*. The cap disc 15*a* is held on its rim portion between the step portion 11*c* and the snap-in ring 16, whereby it is prevented that the cap can slip off or fall out. When the position of the hub 5 relative to the spindle 4 is changed with the cylinder 12, 12 slightly shifting along the axis of the spindle 4, the cap 15 remains fixed on the axis of the spindle 4. The guide 15*b* guides the cylinders by their two sides. To keep the guiding function operative, a predetermined clearance is assured between the cap 15 and each of the cylinders 12, 12. A castle nut 17 is tightened to the end portion of the spindle 4 and is fixed by a split pin 18**.

Figure 8:
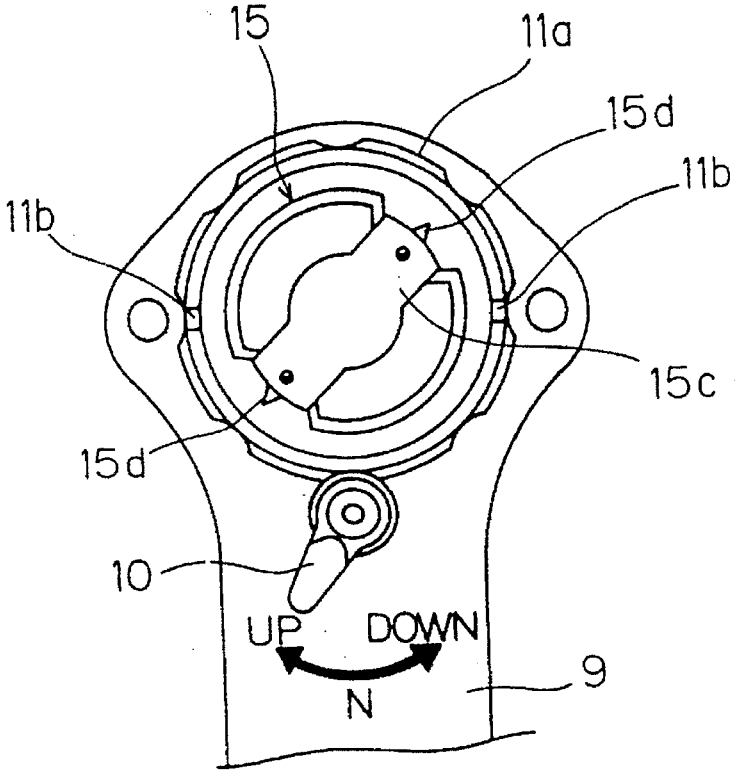
FIG. 8 is a partial front view showing the relative positional relationship of the hub, spindle and other components during the upward winding operation in the first embodiment.
Figure 9:
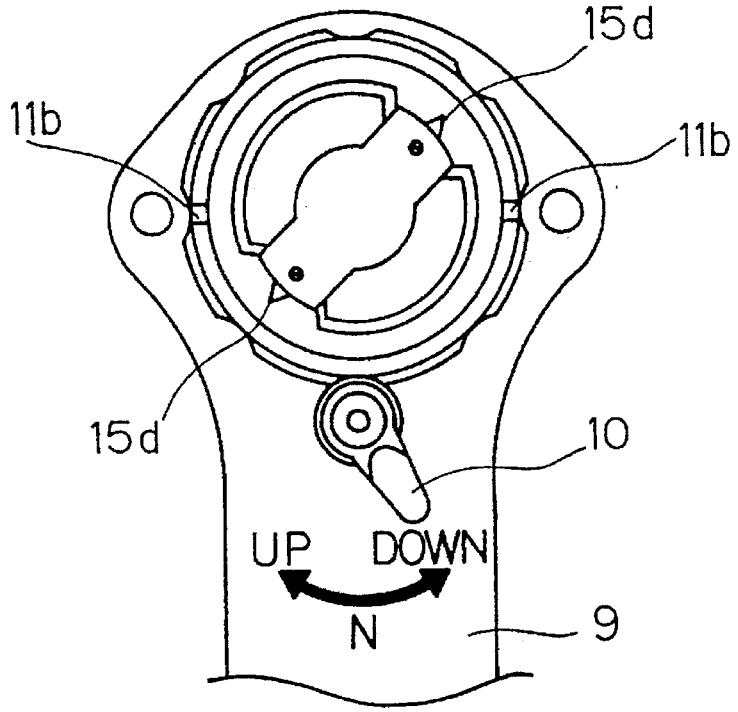
FIG. 9 is a view corresponding to FIG. 8 but during the downward winding operation in the first embodiment.
Figure 10:
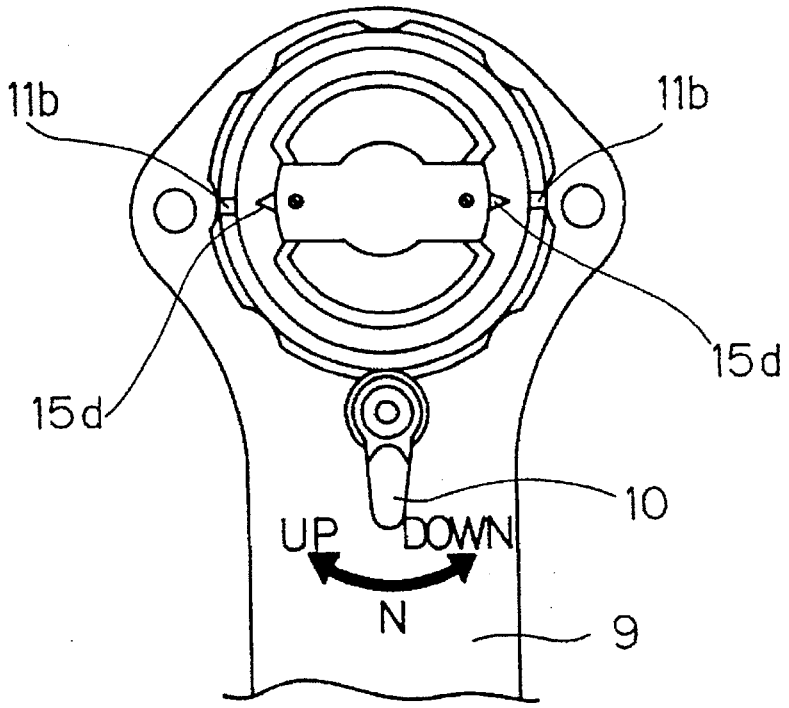
FIG. 10 is a view corresponding to FIG. 8 but during the free running operation in the first embodiment.

The function of the notches **11*b* on the hub side and the indicators on 15*d* the spindle side will now be discussed. During the upward winding operation as shown in FIG. 8 and during the downward winding operation as shown in FIG. 9, the notches 11*b*, 11*b* of the hub side are angularly offset from the indicators 15*d*, 15*d* of the spindle side. During the free-running operation as shown in FIG. 10, the indicators 15*d*, 15*d* of the spindle side are aligned with the notches 11*b*, 11*b*** of the hub side.

Figure 5:
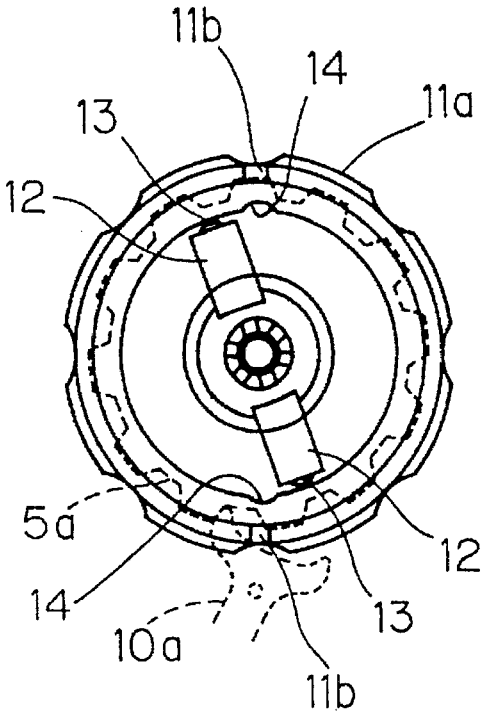
FIG. 5 is a partial front view showing the relative positional relationship of the hub, spindle and other components with a cap removed during the upward winding operation in the first embodiment.

The operation of the first embodiment will now be discussed. To perform an upward winding operation, the switching knob 10 is pivoted clockwise to an "UP" position to cause the left-hand side tip of the pawl **10*a* to engage with the switch gear 5*a* as shown in FIGS. 5 and 8. If the lever 9 is pivoted clockwise in this condition, the torque of a suspended load causes the hub 5 to be tightened onto the spindle 4. The hub 5 squeezes the ratchet gear 7 and the brake linings 8, 8 against the fixed friction plate 6. When the lever 9 is farther repeatedly pivoted clockwise the torque of the lever 9 is transmitted to the load sheave 2 via the hub 5, one brake lining 8, the ratchet gear 7, the other brake lining 8, the fixed friction plate 6 and the spindle 4. The ratchet gear 7 rotates with the ratchet pawls 7***a* oscillating on the teeth of the ratchet gear 7. The load sheave 2 is thus rotated in the upward winding direction to draw up the chain 3.

Figure 6:
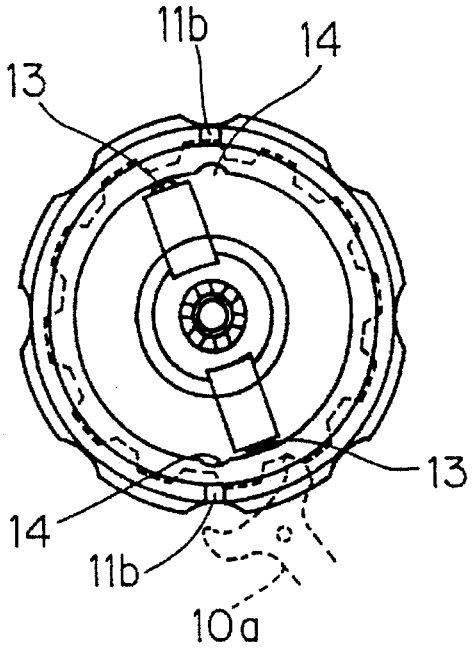
FIG. 6 is a view corresponding to FIG. 5 but during the downward winding operation in the first embodiment.
Figure 7:
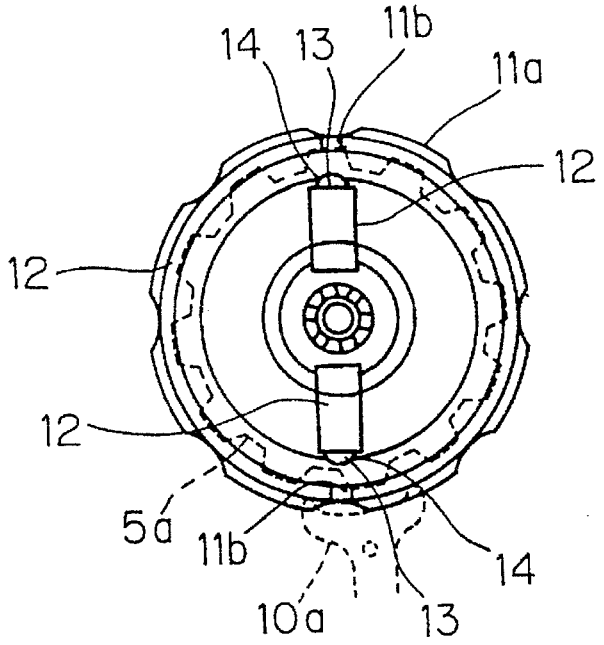
FIG. 7 is a view corresponding to FIG. 5 but during the free running operation in the first embodiment.

To perform a downward winding operation, the switching knob 10 is pivoted counterclockwise to a "DOWN" position to cause the right-hand tip of the pawl 10*a* to engage with the gear 5*a* as shown in FIGS. 6 and 9. The torque of the suspended load causes the hub 5 to be tightened onto the spindle 4. The hub 5 squeezes the ratchet gear 7 and the brake linings 8, 8 against the fixed friction plate 6. If the lever 9 is repeatedly pivoted counterclockwise in this condition, the torque of the lever 9 works to decrease the squeezing force, and the fixed friction plate 6 is caused to slide against the ratchet gear 7, and the fixed friction plate 6, the spindle 4 and the load sheave 2 are caused to rotate in a manner that allows the chain 3 to be paid out.

To perform a free-running operation, the switch knob 10 is turned to a neutral position "N" and the switch pawl 10*a* is disengaged from the switch gear 5*a*. By shifting the screwing position of the hub 5 relative to the spindle 4 from the winding operation position to the free-running operation position, the assist mechanism temporarily holds the hub 5 at the free-running operation position from which a returning action to the winding operation position is blocked. The relative position of the hub 5 with respect to the spindle 4 is maintained, and the braking action is ineffective. Thus, the load sheave is set free to rotate. The indicators 15*d*, 15*d* of the spindle side are aligned with the notches 11*b*, 11*b* of the hub side.

The following four methods are available to shift the screwing position of the hub from its winding operation position to its free running operation position: (1) turning the hub knob 11*a* and the spindle knob 15*c* slightly in mutually opposite directions by hand; (2) turning the spindle knob 15*c* clockwise with the switch knob 10 set to the DOWN position; (3) pulling the chain at the free chain end link side (the chain on the right-hand side in FIG. 2) with the switch knob 10 set to the DOWN position; and (4) turning the hub knob 11*a* counterclockwise with the chain at the free chain end link side held lightly by hand. The method (1) has first been made possible by the present invention. The method (1) allows the screwing position of the hub 5 relative to the spindle 4 to be shifted without the need for operational steps such as rotating the spindle 4 while the lever 9 is put into locking engagement with the hub 5 or with the chain 3 is held by hand. The method (1) prevents an operator from getting his hands dirty from the chain 3, permits an immediate switching to the free-running operation without any complicated operational steps involved, and is easy to perform. Methods (2) through (4) that have been performed in the prior art work in this embodiment as well. The method (2) allows the operator to switch to the free-running operation by a single-handed manipulation. The method (3) is particularly useful when the spindle 4 is out of reach of the operator's hand. The method (4) permits an immediate switching to the free-running operation.

The indicators 15*d*, 15*d* of the spindle side point at or align with the notches 11*b*, 11*b* of the hub side during the free-running operation. At a glance, the operator recognizes that the screwing position of the hub is currently set to the free-running operation position. When the indicators 15*d*, 15*d* of the spindle side are offset from or not aligned with the notches 11*b*, 11*b* of the hub side, the operator recognizes that the screwing position is set to the winding operation position.

The first embodiment employs the assist mechanism which is of a half-locking engagement type. When an external force greater than a threshold, such as the torque by the lever 9, is exerted, the locking of the assist mechanism is automatically released. Thus, a single-step operation is enough to perform winding operation, and thus ease of use is enhanced.

To shift from the free-running operation position to the upward winding operation position, the lever 9 is pivoted clockwise with the switch knob 10 set to the UP position. The torque of the lever 9 overpowers the force with which the balls 13 stay seated in the recesses 14. The balls 13 come out of the recesses 14, and the hub 5 rotates clockwise, releasing the half-locking engagement. The upward winding operation is immediately initiated. To shift from the free-running operation position to the downward winding operation position, the hub knob 11*a* and thus the hub 5 is rotated clockwise with the spindle knob 15*c* held by hand. When the lever 9 is pivoted counterclockwise with the switch knob 10 set to the DOWN position, the half-locking engagement is then released, and the downward winding operation is initiated.

The assist mechanism is not limited to the structure shown in the first embodiment. Any form of assist mechanism is acceptable as long as it blocks the hub from returning to the winding operation once the screwing position of the hub relative to the spindle is shifted from the winding operation position to the free-running operation position. For example, first magnets instead of the cylinders may be disposed on the spindle and second magnets instead of the recesses may be disposed on the hub in such a way that the poles of the first and second magnets attract each other. The force of attraction working between the first and second magnets is used for a half-locking engagement in an assist mechanism. Also contemplated is another construction that offers a full-locking engagement rather than the half-locking engagement. With the hub and the spindle put in the full-locking engagement, the free-running operation is initiated. The term "full-locking engagement" means that the hub remains continuously engaged with the spindle unless a positive release operation is performed. For example, as disclosed in European Patent Application Publication No. 583550A2, instead of the cylinders, a lever having a shape similar to that of the cylinder is used. The lever and the front hub are connected by means of a pin that pierces the lever and the front hub.

Besides the half-locking and full-locking structures, two other assist mechanisms that can be used are a spring mechanism in which an elastic body such as a coil spring is interposed between the friction plate and the hub in such a manner that the elastic body constantly urges the hub outwardly, as has already been described in connection with the prior art, and another mechanism in which a friction material such as a rubber member is interposed between the spindle and the hub so as to increase a sliding resistance generated between the hub and the spindle above a predetermined value. The first mechanism will be discussed as the second embodiment of the present invention referring to FIG. 11, and the second mechanism will be discussed as the third embodiment of the present invention referring to FIG. 12.

Figure 11:
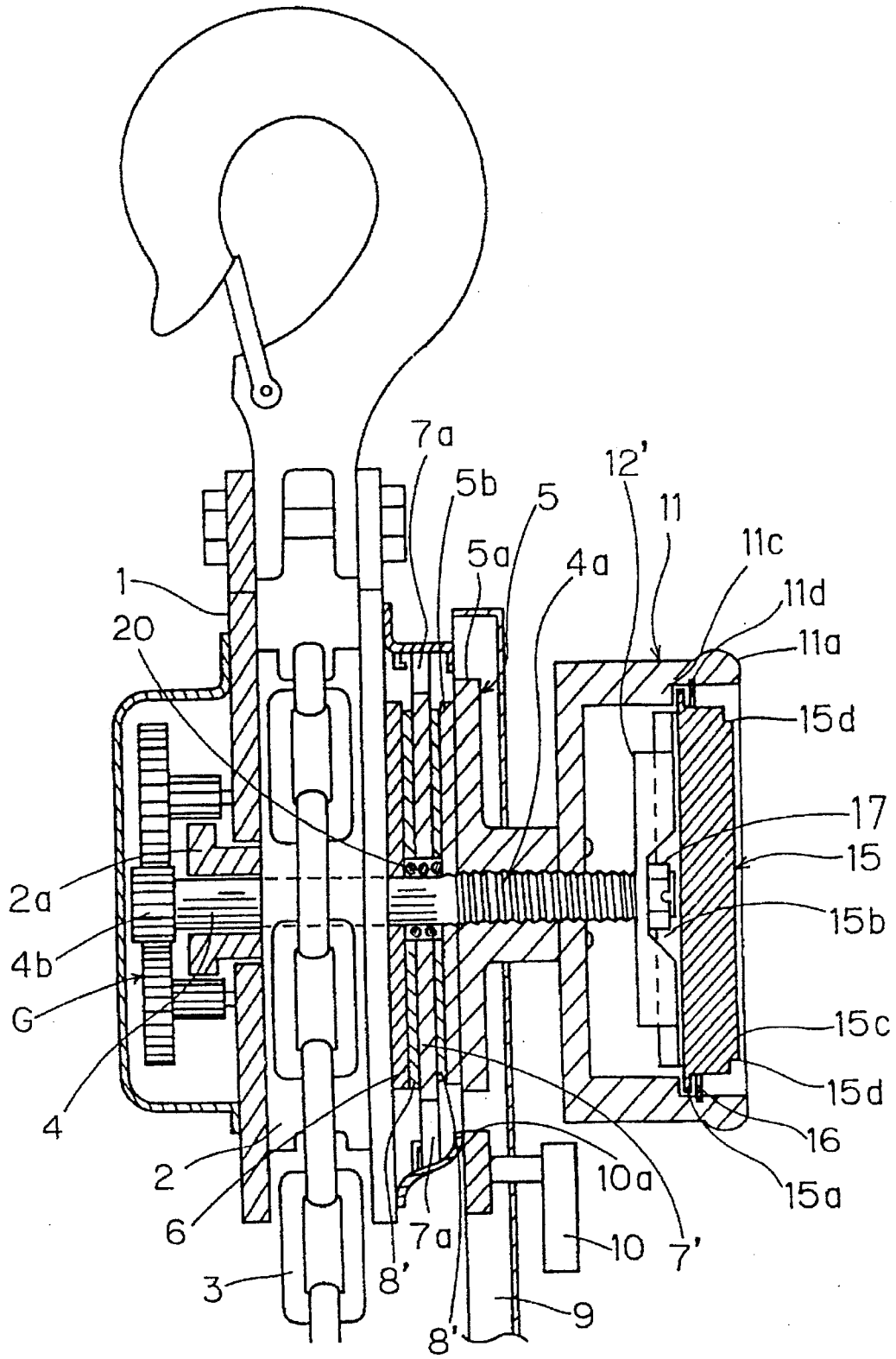
FIG. 11 is a view corresponding to FIG. 1 but showing the second embodiment of the present invention.

In the discussion of the second embodiment referring to FIG. 11, those components equivalent to described with reference to the first embodiment are designated with the same reference numerals and their explanation will not be repeated. In the second embodiment, a lever 12' instead of the cylinders is attached to the front end of the spindle 4 at right angles to the axis of the spindle 4. A coil spring 20 is disposed within the center holes of the ratchet gear 7' and the brake linings 8', 8', coaxially with the spindle 4. The coil spring 20 is anchored to the fixed friction plate 6 and urges the hub 5 toward the front or outwardly. To perform a winding operation in the second embodiment, the same procedure as in the first embodiment applies. To perform a free-running operation, the switch knob 10 is set to the neutral N position and the pawl 10*a* is disengaged from the switch gear 5*a*. Then, any of the four methods, (1) through (4), may be performed to shift the screwing position of the hub 5 relative to the spindle 4 from the winding operation position to the free-running operation position. The contact pressure of the hub 5 against the ratchet gear 7' and the brake linings 8', 8' is decreased. The coil spring 20 pushes the hub 5 outwardly until braking action is ineffective. The load sheave 2 is now free to rotate. The indicators 15*d*, 15*d* of the spindle side are now aligned with the notches 11*b*, 11*b* of the hub side.

Figure 12:
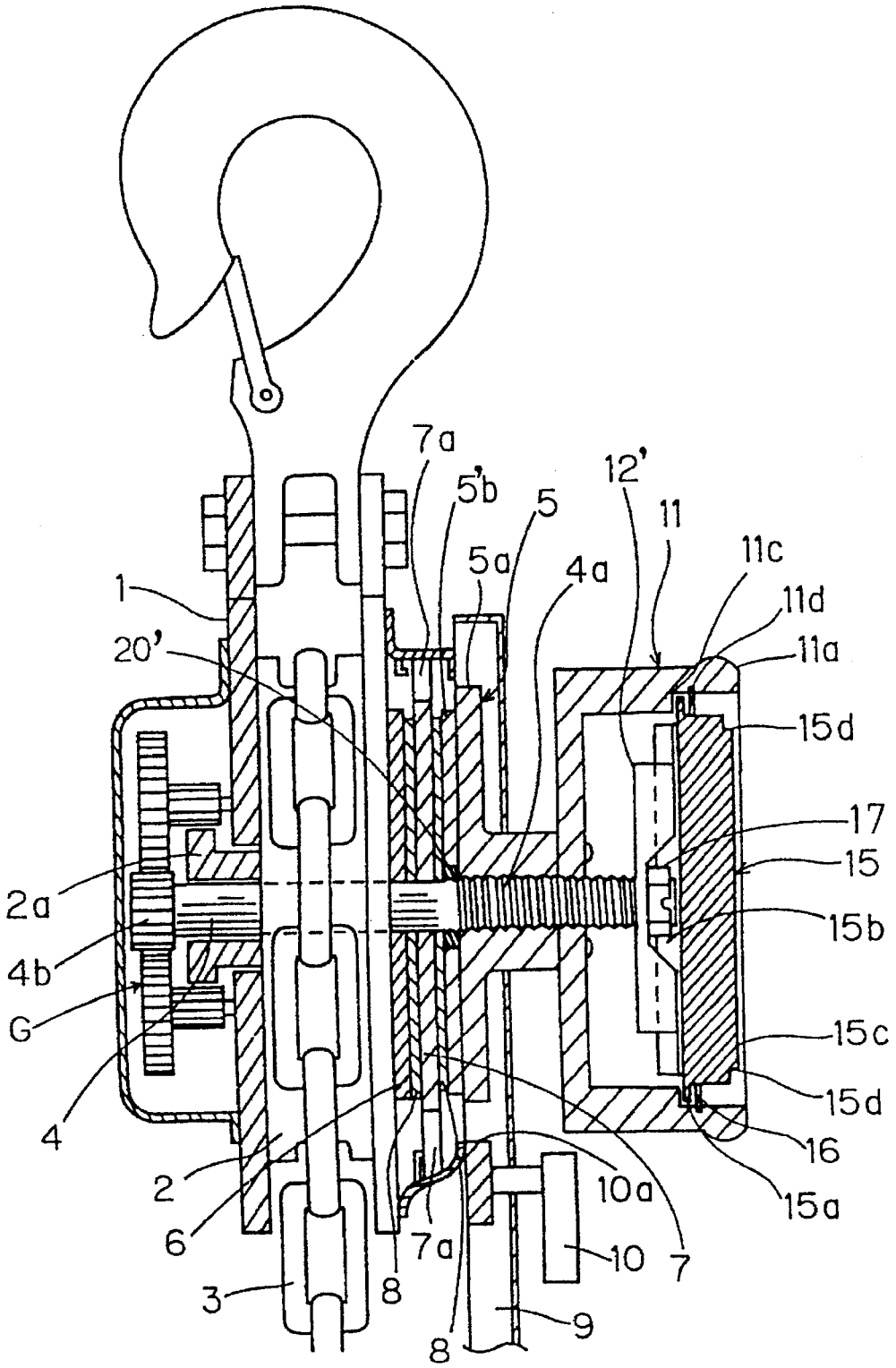
FIG. 12 is a view corresponding to FIG. 1 but showing the third embodiment of the present invention.
Figure 13:
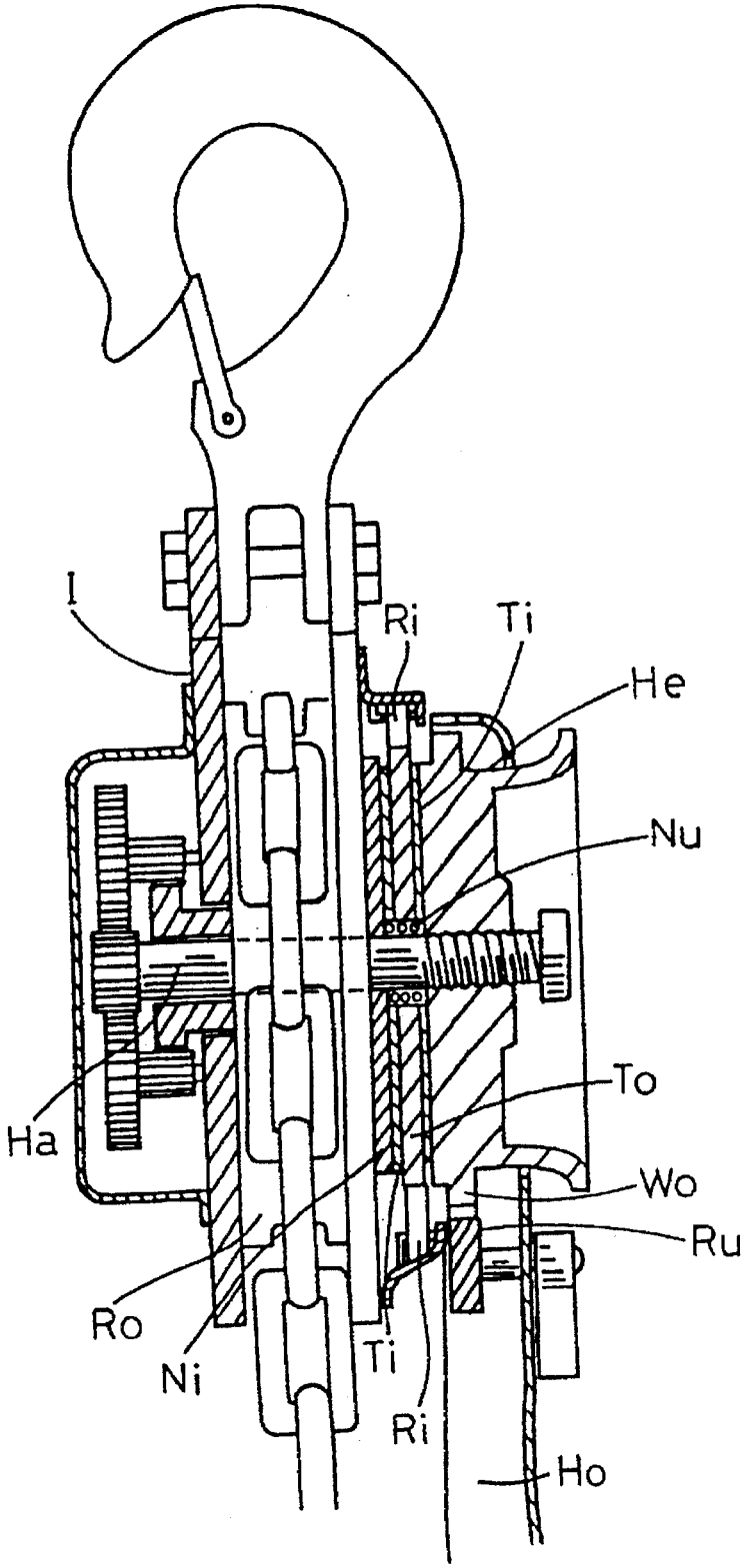
Fig.13 PRIOR ART
FIG. 13 is a view corresponding to FIG. 1 but showing the prior art chain lever hoist.

In the discussion of the third embodiment referring to FIG. 12, those components equivalent to described with reference to the first embodiment are designated with the same reference numerals and their explanation will not be repeated. In the third embodiment, a lever 12' instead of the cylinders is attached to the front end of the spindle 4 at right angles to the axis of the spindle 4. A friction material 20' such as a rubber member is disposed within the center hole of the friction plate 5'*b* of the hub 5. The friction material 20' generates a sliding resistance above a predetermined value between the hub 5 and the spindle 4. To perform a winding operation in the third embodiment, the same procedure as in the first embodiment applies. To perform a free-running operation, the switch knob 10 is set to the neutral N position and the pawl 10*a* is disengaged from the switch gear 5*a*. Then, any of the four methods, (1) through (4), may be performed to shift the screwing position of the hub 5 relative to the spindle 4 from the winding operation position to the free-running operation position. The contact pressure of the hub 5 against the ratchet gear 7' and the brake linings 8', 8' is decreased. The friction force generated by the friction material 20' keeps the hub 5 and the spindle 4 in the free-running operation position, thereby allowing the load sheave 2 to rotate freely. The indicators 15*d*, 15*d* of the spindle side are then aligned with the notches 11*b*, 11*b* of the hub side.

There are many other assist mechanisms contemplated, but their constructions are not discussed herein.

In the second embodiment, when the chain is quickly advanced with the load sheave running freely, only the spindle rotates with the hub failing to follow it. The hub is screwed onto the spindle, narrowing the gap between the fixed friction plate and the hub, activating braking action, and consequently interfering with the free-running operation. Each time such interference takes place, the hub must be rotated by hand to widen the gap between the friction plate and the hub to disable the braking action. Furthermore, when a load that is to be raised is light, the force that acts to screw the hub onto the spindle is accordingly weak. If that force is weaker than the outward urging of the coil spring, then the load will be rapidly lowered with no braking action, which can lead to an accident. Namely, if a coil spring is used that applies a strong urging force to assure a smooth free-running operation, there is a good chance that a free-fall accident will occur in the handling of a light load. Conversely, while the use of a coil spring that applies a weak urging force eliminates the chance of the free-fall accident of a light load, the braking action immediately takes effect when the chain is moved quickly and thus interferes with the free-running operation. In contrast, the first embodiment assures that the assist mechanism keeps the position of the hub 5 relative to the spindle 4 at the open- or no-brake position. Thus, the free-running operation of the hub 5 is assuredly performed. When the half-locking engagement of the assist mechanism is released, the contact pressure of the hub 5 against the ratchet gear 7 and the brake linings 8 is maintained. This eliminates the chance of the free-fall of a light load due to the lack of brake action.

In the first through third embodiments, the separate cap 15 formed of the spindle knob 15*c* and the spindle side indicators 15*d* is attached to the spindle 4. Instead of the cap 15, a spindle knob and spindle side indicators may be integrally formed with the spindle 4. If either the hub or the spindle has any marking on their front, such marking serves as an indicator. In such a case, the relative position of one knob to the other knob will be clearly indicated if an indicator is simply disposed on the knob of either the hub or the spindle which is without marking.

Although the invention has been described with reference to specific example embodiments it will be appreciated that it is intended to cover all modifications and equivalents within the scope of the appended claims.

What is claimed is:

1. A chain lever hoist comprising a mainframe, a spindle freely rotatably mounted on the mainframe, a load sheave mounted on the mainframe so that it is rotatable with the spindle, a fixed friction plate fixed to the spindle, a hub that has a switch gear thereon and that is screwed onto the spindle, a lever that has a switch pawl thereon and that is pivoted about the spindle, a ratchet gear and brake linings, which are disposed between the fixed friction plate and the hub in such a manner that the ratchet gear and the brake linings are freely rotatable about the spindle, a ratchet pawl mounted on the main frame in such a manner that the ratchet pawl engages with the ratchet gear so that the ratchet gear is allowed to rotate only in an upward winding direction, an assist mechanism that blocks the hub from returning to a winding operation position when a screwing position of the hub relative to the spindle is shifted from the winding operation position to a free-running operation position, a hub knob disposed on the hub, a spindle knob disposed on a front end of the spindle that passes through and extends from the hub in a front direction, and indicators disposed on the hub knob and the spindle knob so that the relative position between the hub and the spindle is indicated, wherein the spindle knob comprises a cross-piece arranged on the front end of the spindle, and a cap disk held in a central cylindrical open space within the hub knob so that the cap disk is axially held and rotatable relative to the hub knob, and wherein the cap disk has a guide groove in a backside thereof in which the cross-piece is received for positive rotational engagement and axial play between the cross-piece and the cap disk.

2. The chain lever hoist according to claim 1, wherein the hub includes a front hub part extending in the front direction, the spindle passes through the front hub part, and the assist mechanism includes a pair of cylinders provided in the cross-piece in diametrically opposite directions and at right angles with respect to the spindle, a respective ball received in a radially outer end of each one of the cylinders, a respective coil spring loaded in each one of the cylinders so that the respective ball is urged radially outwardly toward an inner wall of the front hub part, and the inner wall has a pair of recesses in diametrically opposite positions, with the recesses selectably receiving the balls.

3. The chain lever hoist according to claim 1, wherein the assist mechanism includes the cross-piece, and a spring that is loaded within a respective center hole of the ratchet gear and the brake linings and that is arranged coaxially with the spindle, whereby the spring urges the hub away from the fixed friction plate toward the front direction.

4. The chain lever hoist according to claim 1, wherein the assist mechanism includes the cross-piece, and a friction material disposed within a center hole of the hub, whereby the friction material provides a sliding resistance of a predetermined value between the spindle and the hub.

5. The chain lever hoist according to claim 4, wherein the friction material is a rubber member.

6. The chain lever hoist according to claim 1, wherein two diametrically opposed cylinders are provided in the cross-piece, and further comprising a respective spring and a respective ball arranged in each cylinder, with each spring urging the respective ball radially outwardly relative to a rotation axis of the spindle.

7. The chain lever hoist according to claim 1, wherein the hub knob includes an enhanced grip surface on an external cylindrical surface thereof for improved manual grasping and holding of the hub knob against rotation thereof.

8. A lever-operated hoist apparatus comprising a mainframe, a spindle rotatably mounted on said mainframe, a load sheave rotatably mounted relative to said mainframe and coupled for rotation with said spindle, a friction plate fixed to said spindle, a hub including a switch gear screwed onto said spindle, an operating lever pivotably mounted about said spindle, a switch pawl mounted on said lever to selectively engage said switch gear, a ratchet gear rotatably arranged about said spindle between said friction plate and said hub, a ratchet pawl mounted on said mainframe and engaging said ratchet gear to allow said ratchet gear to rotate in only one rotation direction, and a spindle knob arranged on a free front end of said spindle that passes through and extends from said hub, wherein said spindle knob is connected to said spindle for rotation therewith relative to said hub and is connected to said hub for axial movement therewith relative to said spindle, wherein said spindle knob comprises a cross-piece fixed on said front end of said spindle, and a cap disk held in a central cylindrical space within said hub so that said cap disk is axially held and rotatable relative to said hub, and wherein said cap disk has a guide groove in a backside thereof in which said cross-piece is received for positive rotational engagement and axial play between said cross-piece and said cap disk.

9. The hoist apparatus of claim 8, wherein said central cylindrical space within said hub is bounded by a stepped cylindrical inner wall of said hub having a larger diameter wall portion and a smaller diameter wall portion with a stepped shoulder therebetween, wherein an annular groove is provided in said larger diameter wall portion, and further comprising a retaining ring arranged in said annular groove, and wherein said cap disk is retained between said stepped shoulder and said retaining ring.

10. The hoist apparatus of claim 8, wherein said hub includes an enhanced grip surface on an external cylindrical surface thereof for improved manual grasping and holding of said hub against rotation thereof.

11. The hoist apparatus of claim 8, wherein said spindle knob has a radially oriented cylinder hole therein, and further comprising a detent ball and a spring arranged in said cylinder hole with said spring urging said ball radially outwardly from said spindle, and wherein said hub has an inner cylindrical surface that is radially adjacent to said spindle knob and that has a detent depression therein to selectably receive and engage said detent ball.

12. The hoist apparatus of claim 12, having two of said cylinder holes arranged diametrically opposite one another in said spindle knob, and comprising two of said springs and two of said balls urged oppositely radially outwardly by said springs, and having two of said detent depressions at diametrically opposite positions on said inner cylindrical surface of said hub.

13. The hoist apparatus of claim 8, further comprising a force locking mechanism selectably engaging said spindle knob with said hub for torque transmission therebetween up to a threshold relative torque and disengaging said spindle knob from said hub for relative rotation therebetween above a threshold relative torque.

14. The hoist apparatus of claim 13, wherein said force locking mechanism selectably engages said spindle knob with said hub only at a relative rotational alignment of said spindle knob with said hub corresponding to a free-wheeling condition of said load sheave.

15. The hoist apparatus of claim 8, further comprising a rubber friction member frictionally interconnecting said hub with said spindle so as to provide a determined frictional sliding resistance therebetween.

16. In a lever-operated hoist apparatus having a mainframe, a spindle rotatably mounted on said mainframe, a load sheave rotatably mounted relative to said mainframe and coupled for rotation with said spindle, and a hub screwed onto and screwingly movable on said spindle, an improved hub and spindle knob arrangement comprising a spindle knob arranged on a free front end of said spindle that passes through and extends from said hub, wherein said spindle knob is connected to said spindle for rotation therewith relative to said hub and is connected to said hub for axial movement therewith relative to said spindle, wherein said spindle knob comprises a cross-piece fixed on said front end of said spindle, and a cap disk held in a central cylindrical space within said hub so that said cap disk is axially held and rotatable relative to said hub, and wherein said cap disk has a guide groove in a backside thereof in which said cross-piece is received for positive rotational engagement and axial play between said cross-piece and said cap disk.

17. The improved hub and spindle knob arrangement of claim 16, wherein said spindle knob has a radially oriented cylinder hole therein, and further comprising a detent ball and a spring arranged in said cylinder hole with said spring urging said ball radially outwardly from said spindle, and wherein said hub has an inner cylindrical surface that is radially adjacent to said spindle knob and that has a detent depression therein to selectably receive and engage said detent ball.

* * * * *

UNITED STATES PATENT AND TRADEMARK OFFICE

CERTIFICATE OF CORRECTION

PATENT NO. : 5,641,151

DATED : Jun. 24, 1997

INVENTOR(S) : Kataoka

It is certified that error appears in the above-indentified patent and that said Letters Patent is hereby corrected as shown below:

In the "ABSTRACT" line 7, before "operator" insert --An--.

Col. 1, line 10, replace "in shave," by --or sheave,--;
line 34, after "(He)" insert --,--;
line 38, delete ",".

Col. 2, line 19, replace "hoist" by --hoists--;
line 44, replace "(Hal" by --(Ha)--.

Col. 3, line 38, delete "in";
line 39, delete "which";
line 51, replace "which," by --in which--.

Col. 6, line 33, replace "15d," by -- 15d--.

Col. 7, line 5, replace "farther" by --further--, after "clockwise" insert --,--;
line 53, replace "with" by --while--.

Col. 12, (Claim 12) line 11, replace "claim 12," by --claim 11,--.

Signed and Sealed this

Fourteenth Day of October, 1997

*Attest:*

Bruce Lehman

BRUCE LEHMAN

*Attesting Officer*

*Commissioner of Patents and Trademarks*